US011683651B2

(12) United States Patent
Song

(10) Patent No.: US 11,683,651 B2
(45) Date of Patent: Jun. 20, 2023

(54) ADAPTIVE SOLID HEARING SYSTEM ACCORDING TO ENVIRONMENT CHANGE AND NOISE CHANGE

(71) Applicant: Olive Union, Inc., Seoul (KR)

(72) Inventor: Myung Geun Song, Seoul (KR)

(73) Assignee: Olive Union, Inc., Seoul (KR)

( * ) Notice: Subject to any disclaimer, the term of this patent is extended or adjusted under 35 U.S.C. 154(b) by 0 days.

(21) Appl. No.: 17/280,221

(22) PCT Filed: Jan. 3, 2019

(86) PCT No.: PCT/KR2019/000077
§ 371 (c)(1),
(2) Date: Mar. 26, 2021

(87) PCT Pub. No.: WO2020/141634
PCT Pub. Date: Jul. 9, 2020

(65) Prior Publication Data

US 2021/0345050 A1 Nov. 4, 2021

(30) Foreign Application Priority Data

Jan. 2, 2019 (KR) ..... 10-2019-0000057

(51) Int. Cl.
*H04R 25/00* (2006.01)
*H04R 1/10* (2006.01)

(52) U.S. Cl.
CPC ..... *H04R 25/558* (2013.01); *H04R 1/1016* (2013.01); *H04R 25/50* (2013.01); *H04R 25/552* (2013.01); *H04R 25/554* (2013.01); *H04R 2460/01* (2013.01)

(58) Field of Classification Search
CPC .... H04R 25/558; H04R 1/1016; H04R 25/50; H04R 25/552; H04R 25/554; H04R 2460/01; H04R 25/43; H04R 25/407
See application file for complete search history.

(56) References Cited

U.S. PATENT DOCUMENTS

| | | | | |
|---|---|---|---|---|
| 8,126,175 | B2 | 2/2012 | Tateno et al. | |
| 9,055,377 | B2 | 6/2015 | Kinsbergen et al. | |
| 9,364,669 | B2 * | 6/2016 | Kehtarnavaz ..... | A61N 1/0541 |
| 9,723,415 | B2 * | 8/2017 | Gran ..... | H04R 25/558 |
| 9,930,447 | B1 | 3/2018 | Termeulen et al. | |

(Continued)

FOREIGN PATENT DOCUMENTS

| | | | |
|---|---|---|---|
| JP | 2007336308 | A | 12/2007 |
| KR | 1020130133790 | A | 12/2013 |

(Continued)

OTHER PUBLICATIONS

English Abstract of KR1020130133790, Dec. 9, 2013.

(Continued)

*Primary Examiner* — Brian Ensey
(74) *Attorney, Agent, or Firm* — Cahn & Samuels, LLP

(57) ABSTRACT

A user is allowed to three-dimensionally recognize environment change and noise change corresponding to the sound directionality of the left and right sides through a control parameter that is set by analyzing an audio signal received from a first smart hearing device formed on one side and a second smart hearing device formed on an opposite side.

9 Claims, 9 Drawing Sheets

(56) References Cited

U.S. PATENT DOCUMENTS

| | | | | |
|---|---|---|---|---|
| 10,067,734 | B2 | 9/2018 | Watson et al. | |
| 10,225,668 | B2 * | 3/2019 | Merks | H04R 25/405 |
| 2018/0088900 | A1 | 3/2018 | Glaser et al. | |

FOREIGN PATENT DOCUMENTS

| | | | |
|---|---|---|---|
| KR | 101585793 | B1 | 1/2016 |
| KR | 1020170138588 | A | 12/2017 |
| KR | 101903374 | B1 | 11/2018 |
| KR | 1020180125384 | A | 11/2018 |

OTHER PUBLICATIONS

English Abstract of KR101585793, Jan. 15, 2016.
English Abstract of KR1020170138588, Dec. 15, 2017.
English Abstract of KR101903374, Nov. 22, 2018.
English Abstract of KR1020180125384, Nov. 23, 2018.
European Patent Office, Supplementary European Search Report, dated Oct. 14, 2021, pp. 1-11.
English Abstract of JP2007336308A, Dec. 27, 2007.

* cited by examiner

ADAPTIVE SOLID HEARING SYSTEM ACCORDING TO ENVIRONMENT CHANGE AND NOISE CHANGE

This application is a US national stage application of PCT/KR2019/000077 filed on 3 Jan. 2019, which claims priority of Korean Patent Application No. 10-2019-0000057 filed on 2 Jan. 2019, the entire contents of which are hereby incorporated by reference.

TECHNICAL FIELD

The disclosure relates to an adaptive solid hearing system according to environment change and noise change and a method thereof, and more particularly, to a technology that is provided to three-dimensionally recognize environment change and noise change according to the sound directions of the left and right sides through a control parameter set by analyzing an audio signal received from a first smart hearing device formed on one side and a second smart hearing device formed on an opposite side.

BACKGROUND ART

In recent years, due to the rapid development of medical engineering technology, patients who have not received much help from wearing hearing aids in the past have been able to improve their hearing ability by selecting and wearing suitable hearing aids.

Among medical devices, a hearing aid is a high-tech medical device that is always attached to the body. A hearing aid should be continuously managed according to change in hearing, and A/S should be received for a part damaged by moisture and foreign substances in the ear. Therefore, a hearing aid is considered to be one of the most important technologies among medical engineering technologies.

A conventional hearing aid is in the form of a trumpet-type sound collector, but now it is usually used in the form of an electric hearing aid that helps amplify sound. In addition, there is a bone type of hearing aid that is mounted on a pneumatization portion, but it has usually an airway-type structure. The hearing aid receives a sound wave through a microphone and converts the sound wave into an electric vibration. The hearing aid amplifies the electric vibration and converts the electric vibration into a sound wave through an earphone, so that the sound wave can be heard through ears.

Recently, research on a more powerful hearing aid dedicated processor has been conducted. The hearing aid dedicated processor has a processing speed that is more than twice as fast as that of an existing processor while being equipped with a memory, and includes chips and parts that are made small with advanced nanotechnology.

However, because the existing hearing aid technology was set based on the hearing data of a hearing impaired person (hereinafter, referred to as a "user"), there was a limitation that data on real-time ambient noise of the user could not be applied.

DETAILED DESCRIPTION OF THE INVENTION

Technical Problem

One aspect of the disclosure is to provide a three-dimensional perception of environment changes and noise changes according to sound directionality of the left and right by using a first smart hearing device and a second smart hearing device worn on the right and left sides of the user, respectively.

In addition, another aspect of the disclosure is to recognize a user's voice signal and noise signal through first and second microphones included in a first smart hearing device and third and fourth microphones included in a second smart hearing device to collect ambient sounds more three-dimensionally.

In addition, still another aspect of the disclosure is to set different control parameters of a first smart hearing device and a second smart hearing device based on an analysis result.

Technical Solution

According to one aspect of the disclosure, an adaptive solid hearing system includes a first smart hearing device that transmits a first audio signal including a voice signal and a noise signal received from a first microphone and a second microphone formed on one side, and sets a first control parameter based on information about a result of analyzing the first audio signal to provide a sound of the one side, a second smart hearing device that transmits a second audio signal including a voice signal and a noise signal received from a third microphone and a fourth microphone formed on an opposite side, and sets a second control parameter information about a result of analyzing the second audio signal to a sound of the opposite side, a mobile device that transmits the first audio signal and the second audio signal to an outside, and controls the first smart hearing device and the second smart hearing device, and an external server that transmits result information about sound directionality analyzed by applying a machine learning scheme to the first audio signal and the second audio signal.

The first smart hearing device and the second smart hearing device may include the first microphone and the third microphone positioned near a mouth of a user, and the second microphone and the fourth microphone positioned at a spaced distance from the mouth of the user, respectively.

The first microphone and the third microphone may collect a voice signal of the user at the one side and the opposite side, and the second microphone and the fourth microphone may collect a noise signal of the one side and a noise signal of the opposite side.

The first microphone and the third microphone may be paired with each other, the second microphone and the fourth microphone may be paired with each other, and one microphone paired with another microphone may be automatically set according to a setting applied to the another microphone.

The first smart hearing device may set the first control parameter of at least one among an amplification value change corresponding to an environment change, a volume control and a frequency control, based on hearing data of the user and the result information received from the mobile device, and provide the sound of the one side which is user-customized, and the second smart hearing device may set the second control parameter of at least one among an amplification value change, a volume control, and a frequency control according to the environment change, based on hearing data of the user and the result information received from the mobile device, and provide the sound of the opposite side which is user-customized.

The first smart hearing device may set the first control parameter to the voice signal and the noise signal of a digital signal received from the first microphone and the second microphone to adjust a balance of at least one of the amplification value change, the volume control and the frequency control, and convert a digital signal for the adjusted signal into an analog signal to provide the user with the sound of the one side, and the second smart hearing device may set the second control parameter to the voice signal and the noise signal of a digital signal received from the third microphone and the fourth microphone to adjust a balance of at least one of the amplification value change, the volume control and the frequency control, and convert a digital signal for the adjusted signal into an analog signal to provide the user with the sound of the opposite side.

Each of the first smart hearing device and the second smart hearing device may provide the sound of the one side and the sound of the opposite side user-customized to the user to enable the user to recognize an environment change and a noise change corresponding to sound directionality of left and right sides in three dimensions.

Each of the first smart hearing device and the second smart hearing device may set the first control parameter and the second control parameter having different parameter values based on left hearing data and right hearing data of a user.

The mobile device may transmit the first audio signal and the second audio signal received from the first smart hearing device and the second smart hearing device through a short-range wireless communication module to the external server, and transmit the result information received from the external server to the first smart hearing device and the second smart hearing device.

The mobile device may control one or more of power on/off, signal collection, and parameter setting of each of the first smart hearing device and the second smart hearing device corresponding to a selection input of a user.

The external server may analyze the first audio signal and the second audio signal through a machine learning technique of one of support vector machine (SVM) and kMeans schemes to generate the result information about sound directionality corresponding to environment change or ambient noise.

The first smart hearing device may include the first microphone that receives a voice signal of a user, the second microphone that receives a noise signal around the user, a transmission unit that transmits the first audio signal including the voice signal and the noise signal received from the first microphone and the second microphone, a reception unit that receives the result information from the mobile device in response to processing of the first audio signal by the external server, and a control unit that sets the first control parameter based on the result information.

The second smart hearing device may include the third microphone that receives a voice signal of a user, the fourth microphone that receives a noise signal around the user, a transmission unit that transmits the second audio signal including the voice signal and the noise signal received from the third microphone and the fourth microphone, a reception unit that receives the result information from the mobile device in response to processing of the second audio signal by the external server, and a control unit that sets the second control parameter based on the result information.

Another aspect of the disclosure, a method of operating a mobile device in an adaptive solid hearing system that adapts to environment change and noise to provide three-dimensional sound includes receiving a first audio signal and a second audio signal including a voice signal and a noise signal from a first smart hearing device formed on one side and a second smart hearing device formed on an opposite side, transmitting the first audio signal and the second audio signal to an external server, receiving result information on sound directionality analyzed by a machine learning scheme from the external server, and providing the result information to the first smart hearing device and the second smart hearing device, wherein the first smart hearing device and the second smart hearing device may set a first control parameter and a second control parameter based on the result information to provide a sound of the one side and a sound of the opposite side to a user.

Advantageous Effects of the Invention

According to an embodiment of the disclosure, it is possible to provide a hearing aid service customized for the environment change and noise change corresponding to the sound directionality of the left and right by using the first and second smart hearing devices worn on the right and left sides of the user, thereby improving the convenience of using a hearing aid.

In addition, according to an embodiment of the disclosure, the voice signal of the user and the noise signal may be recognized through the first and second microphones included in the first smart hearing device and the third and fourth microphones included in the second smart hearing device, so that it is possible to collect the ambient sound more three-dimensionally and remove appropriate noise accordingly.

DETAILED DESCRIPTION OF INVENTION

Figure 1:
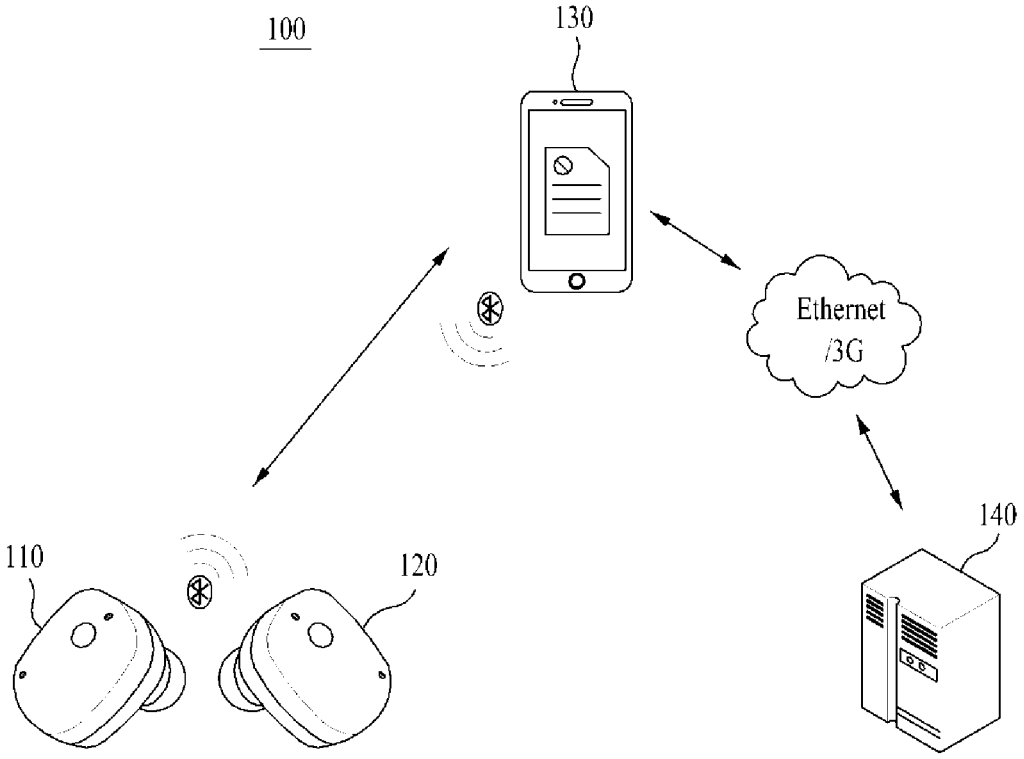
FIG. 1 is a diagram illustrating a configuration of an adaptive solid hearing system according to an embodiment of the disclosure.

Hereinafter, embodiments of the disclosure will be described in detail with reference to the accompanying drawings. However, it should be understood that the disclosure is not limited to the following embodiments. In addition, the same reference numerals used in each drawing represent the same elements.

In addition, terminologies used herein are defined to appropriately describe the exemplary embodiments of the disclosure and thus may be changed depending on a viewer, the intent of an operator, or a custom. Accordingly, the terminologies must be defined based on the following overall description of this disclosure.

The disclosure is a technology related to an adaptive solid hearing system according to environment change and noise change, and a method thereof, in which a first smart hearing device and a second smart hearing device worn on left and right sides of a user, respectively are used to set a control parameter based on the result of analyzing a first audio signal on the left and a second audio signal on the right received through first and second microphones included in the first smart hearing device and third and fourth microphones included in the second smart hearing device, such that it is possible to allow the user to three-dimensionally recognize the environment and noise changes according to the sound directionality of the left and right sides.

In this case, a smart hearing device according to an embodiment of the disclosure is a hearing aid that provides amplified sound such that a user with low hearing ability can hear the sound.

Hereinafter, an adaptive solid hearing system which is capable of improving convenience by providing a customized hearing service for a user by controlling at least one of amplification values, volumes and frequencies of a voice signal and a noise signal in real time corresponding to environment change and noise change, and a method thereof according to an embodiment of the disclosure will be described in detail with reference to FIGS. 1 to 7.

FIG. 1 is a diagram illustrating a configuration of an adaptive solid hearing system according to an embodiment of the disclosure.

Referring to FIG. 1, an adaptive solid hearing system according to an embodiment of the disclosure is provided to three-dimensionally recognize an environment change and a noise change corresponding to sound directionality of left and right sides through a control parameter set by analyzing an audio signal received from a first smart hearing device formed on one side and a second smart hearing device formed on an opposite side.

To this end, an adaptive solid hearing system 100 according to an embodiment of the disclosure includes a first smart hearing device 110, a second smart hearing device 120, a mobile device 130, and an external server 140.

The first smart hearing device 110 transmits a first audio signal including a voice signal and a noise signal received from a first microphone and a second microphone formed on one side, and sets a first control parameter based on information about the result of analyzing the first audio signal to provide a sound of one side.

The second smart hearing device 120 transmits a second audio signal including a voice signal and a noise signal received from a third microphone and a fourth microphone formed on an opposite side, and sets a second control parameter based on information about the result of analyzing the second audio signal to provide a sound of the opposite side.

The first and second smart hearing devices 110 and 120 may include the first microphone and the third microphone located near the mouth of a user, and the second microphone and the fourth microphone located at a distance from the user mouth. In this case, the first and third microphones may collect voice signals of the user from one side and the opposite side, and the second and fourth microphones may collect noise signals from the one side and the opposite side.

In more detail, the first smart hearing device 110 may be mounted on the left ear of the user, receive the voice signal of the user from the left side through the first microphone located near the user mouth, and receive a noise signal from the left side through the second microphone located at a spaced distance from the user mouth. In addition, the second smart hearing device 120 may be mounted on the right ear of the user, receive the user voice signal from the right side through the third microphone located near the user mouth, and receive a noise signal from the right side through the fourth microphone located at a spaced distance from the user mouth.

In this case, the first microphone of the first smart hearing device 110 and the third microphone of the second smart hearing device 120 may be paired with each other, and the second microphone of the first smart hearing device 110 and the fourth microphone of the second smart hearing device 120 may be paired with each other. The microphone paired with any one microphone may be automatically set corresponding to the setting applied to one microphone. For example, when the volume of the first microphone is adjusted by the first control parameter, the volume of the paired third microphone may also be automatically adjusted. As another example, when the second microphone of the first smart hearing device 110 is powered on, the paired fourth microphone of the second smart hearing device 120 may also be automatically powered on.

Each of the first and second smart hearing devices 110 and 120 may set the first and second control parameters having different parameter values based on left hearing data and right hearing data of the user.

As an example, each of the first and second smart hearing devices 110 and 120 may include hearing data (personal hearing profile) for the left and right sides of the user who uses a hearing aid. For example, because the hearing data of the left side of the user may be different from the hearing data of the right side of the user, each of the first and second smart hearing devices 110 and 120 may include user-customized hearing data including a user's preferred volume, a specific perceivable volume, a specific frequency, an amplification value that does not feel foreign, volume and a frequency range. In this case, the user hearing data may be stored and maintained in the mobile device 130 and the external server 140.

However, the hearing data is not limited to items such as an amplification value, volume, a frequency, and the like, or numerical values. For example, the hearing data may further include user preference and a numerical value for at least one among nonlinear compression information that amplifies a small sound to be large and reduces a loud sound to be small, directional information that accurately detects the direction in which the sound is heard, and feedback information that amplifies the sound received through a microphone to help to be well heard without other noise, and noise removal information that reduces noise.

The first and second smart hearing devices 110 and 120 according to an embodiment of the disclosure may set the first and second control parameters of at least one among amplification value change, volume control and frequency control corresponding to environment change and noise change based on the user hearing data and the result information about the analyzed sound directionality received from the mobile device 130, and may provide a customized hearing aid service for the left and right sides.

In more detail, the first and second smart hearing devices 110 and 120 may set the first and second control parameters of at least one of amplification value change, volume control and frequency control corresponding to environment change based on the user hearing data and the result information about the analyzed sound directionality received from the mobile device 130, and may provide user-customized right and left sounds.

In an embodiment, the first smart hearing device 110 may set the first control parameter to the voice signal and noise signal of the digital signal received from the first and second microphones to adjust a balance of at least one of amplification value change, volume control, and frequency control, and convert a digital signal of the adjusted signal into an analog signal to be transmitted to the user as a left sound.

As another example, the second smart hearing device 120 may set the second control parameter to the voice signal and noise signal of the digital signal received from the third and fourth microphones to adjust a balance of at least one of amplification value change, volume control and frequency control, and convert a digital signal of the adjusted signal into an analog signal to be transmitted to the user as a right sound.

For example, at least one of the amplification value, volume, and frequency according to the audio signal received from the first to fourth microphones is out of a reference range preset or preferred by the user. This may be due to a change in environment in which the user is located, a change in the user voice, or a mechanical error. Accordingly, the first and second smart hearing devices 110 and 120 may adjust the balance of at least one of the amplification value, volume, and frequency for the audio signal based on the first and second control parameters, and convert the digital signal according to the adjusted balance into an analog signal (sound energy) to be provided to the user as sound.

That is, the first and second smart hearing devices 110 and 120 of the adaptive solid hearing system 100 according to an embodiment of the disclosure may transmit the first and second audio signals including a voice signal and a noise signal received from the first to fourth microphones through the mobile device 130 to the external server 140, receive the analysis result, automatically set the first and second control parameters for the first and second audio signals based on the information related to the user hearing data and analysis result, and provide the hearing aid service optimized for a changing situation without a need to separately adjust the volume or frequency by the user, thereby improving the convenience of using a hearing aid.

In addition, that is, each of the first and second smart hearing devices 110 and 120 of the adaptive solid hearing system 100 according to an embodiment of the disclosure may provide the left sound and the right sound customized to the user to allow the user to three-dimensionally recognize the environment change and noise change due to the sound directionality of the left and right sides.

The mobile device 130 transmits the first and second audio signals to an outside, and controls the first and second smart hearing devices 110 and 120.

As shown in FIG. 1, the first and second smart hearing devices 110 and 120, and the mobile device 130 transmit and receive data through Bluetooth communication, which is a short-range wireless communication module. For example, the mobile device 130 may receive the first and second audio signals including the voice signal and noise signal from the first and second smart hearing devices 110 and 120 through Bluetooth communication.

Thereafter, the mobile device 130 may transmit the first and second audio signals to the external server 140 through wireless data communication of Ethernet/3G, 4G or 5G. In addition, the mobile device 130 may receive information related to the analysis result from the external server 140 through wireless data communication, and provide the information related to the analysis result to the first and second smart hearing devices 110 and 120 through Bluetooth communication.

In this case, the mobile device 130 in the adaptive solid hearing system 100 according to an embodiment of the disclosure, which is a terminal possessed by the user, such as a personal computer (PC), a laptop computer, a smart phone, a tablet, a wearable computer, and the like, may perform overall service operations, such as service screen configuration, data input, data transmission and reception, data storing, and the like, under control of a web/mobile site or a dedicated application. In addition, the mobile device 130 may refer to an application downloaded and installed in the mobile device.

According to an embodiment, the mobile device 130 may display a screen including a plurality of items located in a plurality of areas, respectively through a display (not shown), and display another screen including at least one item related to a function based on a touch-sensitive surface, a sensor, or a set of sensors that receives an input from a user based on a haptic or tactile contact. In addition, the mobile device 130 may receive a user selection input through an input unit (not shown) such as a keyboard, a touch display, a dial, a slider switch, a joystick, mouse, and the like, and output information related to a customized hearing aid service through an output unit (not shown) including an audio module, a speaker module, and a vibration module.

The mobile device 130 may interwork with each of the first and second smart hearing devices 110 and 120 to provide a screen for testing the user hearing and information related to various reports accordingly. In this case, the report may be a history index or record for a customized hearing aid service over time.

In addition, the mobile device 130 may include user information and hearing data corresponding to the user information, and may store and maintain an appropriate range of an amplification value, volume, and frequency that the user prefers. Further, the mobile device 130 may match information related to the analysis result from the external server 140 with the voice signal and noise signal received from each of the first and second smart hearing devices 110 and 120 to form a database.

In addition, the mobile device 130 may power on or off each of the first and second smart hearing devices 110 and 120 corresponding to a selection input of the user, and may manually control numerical values such as the amplification value, volume, and frequency of the first and second smart hearing devices 110 and 120 based on the information about the analysis result received from the external server 140.

In addition, the mobile device 130, which is paired with a serial number or device information assigned to each of the first and second smart hearing devices 110 and 120, may perform battery management, loss management, and failure management of the first and second smart hearing devices 110 and 120.

The external server 140 transmits information about the result of sound directionality analyzed by applying a machine learning scheme to the first and second audio signals.

For example, the external server 140 may communicate with the mobile device 130 through wireless data communication of Ethernet/3G, 4G or 5G, and may analyze the first and second audio signals received from the mobile device 130 through at least one machine learning scheme of a support vector machine (SVM) scheme and a kMeans scheme to generate the result information of the sound directionality according to the environment change or ambient noise.

The external server 140 may analyzes the first and second audio signals through the machine learning scheme to detect changes in use environment and work environment based on a user location, and may detect a change in a numerical value of at least one of an amplification value, volume, and a frequency due to the environment change. Accordingly, the external server 140 may obtain an item and a numerical value of at least one of the amplification value, volume, and frequency that are out of an appropriate range based on the user hearing data to generate an analysis result including information on the obtained item and numerical value and information on a fluctuation of the numerical value for entry into an appropriate range.

Thereafter, the external server 140 may transmit information related to the analysis result to the mobile device 130 through wireless data communication of Ethernet/3G, 4G or 5G, and the mobile device 130 may transmit information related to the analysis result to each of the first and second smart hearing devices 110 and 120 through Bluetooth communication.

In this case, the external server 140 may store the user information, the hearing data corresponding to the user information, and the digitized appropriate ranges of the amplification value, volume, and frequency preferred by the user, and basically match the first and second smart hearing devices 110 and 120 corresponding to the user information and the mobile device 130 to form a database. That is, the external server 140 may analyze the audio signal received from the mobile device 130 based on the stored and maintained data, transmit the information related to the analysis result to the first and second smart hearing devices 110 and 120 or the mobile device 130, and match the analysis result information with the user information to form a database.

According to an embodiment, the process of analyzing result information on sound directionality by applying a machine learning scheme to the first and second audio signals performed by the external server 140 may be performed by the mobile device 130. In this case, the adaptive solid hearing system 100 according to another embodiment of the disclosure may include only the first and second smart hearing devices 110 and 120, and the mobile device 130.

Figure 2A:
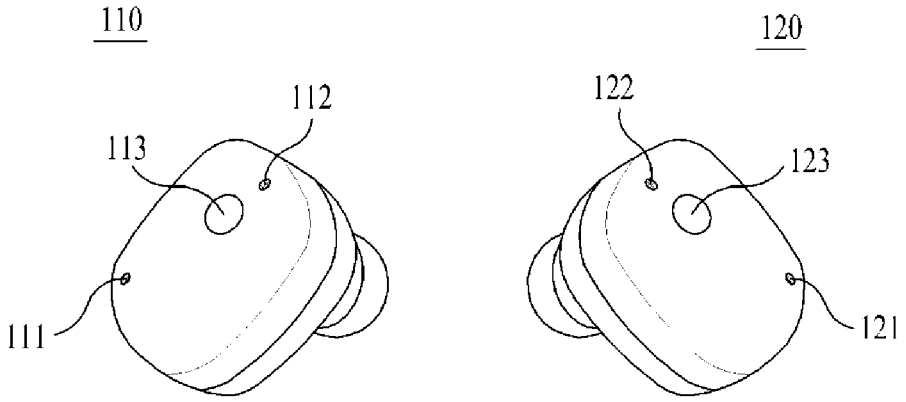
FIGS. 2A and 2B illustrate product examples of first and second smart hearing devices according to an embodiment of the disclosure.
Figure 2B:
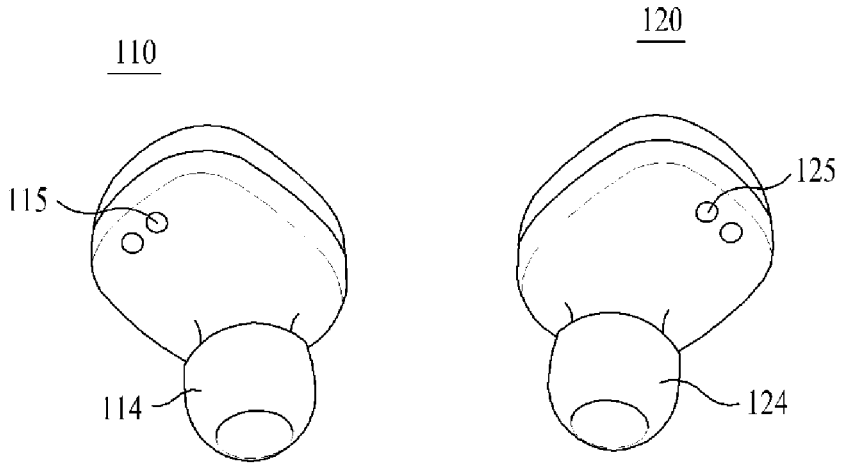

FIGS. 2A and 2B illustrate product examples of first and second smart hearing devices according to an embodiment of the disclosure.

In more detail, FIG. 2A is a diagram illustrating front examples of the first and second smart hearing devices according to an embodiment of the disclosure, and FIG. 2B is a diagram illustrating rear examples of the first and second smart hearing devices according to an embodiment of the disclosure.

Referring to FIG. 2A, the first smart hearing device 110 according to the embodiment of the disclosure includes a first microphone 111, a second microphone 112, and an on/off switch 113. The second smart hearing device 120 includes a third microphone 121, a fourth microphone 122, and an on/off switch 123. Although the first and second smart hearing devices 110 and 120, which are worn on the left and right ears of a user, respectively, are illustrated, the location and shape in which the smart hearing device is worn are not limited thereto.

In this case, the first and third microphones 111 and 121 may be located adjacent to the user mouth to receive a voice signal mainly for the user voice, and may be located below the on/off switches 113 and 123 to be relatively close to the user mouth compared to the second and fourth microphones 112 and 122.

In addition, the second and fourth microphones 112 and 122 may be located as far away as possible from the user mouth to receive a noise signal mainly for ambient noise corresponding to the user location, and may be located above the on/off switches 113 and 123 to be located relatively far from the user mouth compared to the first and third microphones 111 and 121.

Further, the cavities (or holes) of the first to fourth microphone 111 to 122 may orient in the same direction in order to collect a uniform voice signal and noise signal, respectively, and to remove appropriate noise accordingly.

As shown in FIG. 2A, according to an embodiment of the disclosure, the first smart hearing device 110 may include two microphones 111 and 112 having different positions, and the second smart hearing device 120 may include two microphones 121 and 122 having different positions. The first and third microphones 111 and 121 may be set as main in software, and the second and fourth microphones 112 and 122 may be used as secondary input sources, thereby uniformly collecting mutually different voice signals and noise signals.

In this case, the first microphone 111 of the first smart hearing device 110 and the third microphone 121 of the second smart hearing device 120 may be paired with each other, and the second microphone 112 of the first smart hearing device 110 and the fourth microphone 122 of the second smart hearing device 120 may be paired with each other, such that one microphone paired with another microphone may be automatically set corresponding to the setting applied to the another microphone.

For example, when the volume of the first microphone 111 is increased to a specified value by the first control parameter, the volume of the paired third microphone may also be automatically adjusted up to a specified value. As another example, when the second microphone 112 of the first smart hearing device 110 is powered on, the fourth microphone 122 of the paired second smart hearing device 120 may also be automatically powered on.

Referring to FIG. 2A, the first smart hearing device 110 and the second smart hearing device 120 include on/off switches 113 and 123. The on/off switches 113 and 123 power on or off the first and second smart hearing devices 110 and 120, respectively. For example, when the user touches, pushes, or presses the switch-type on/off switches 113 and 123, the first and second smart hearing devices 110 and 120 may be turned on or off. In this case, when at least one of the first and second smart hearing devices 110 and 120 is turned on or off, the remaining smart hearing device paired may be also turned on in the same manner.

Referring to FIG. 2B, according to an embodiment of the disclosure, the first smart hearing device 110 includes a charging module 115 and a speakers 114, and the second smart hearing device 120 includes a charging module 125 and a speaker 124.

The first and second smart hearing devices 110 and 120 according to an embodiment of the disclosure may include the corresponding charging modules (terminals) 115 and 125 as charging devices.

For example, the first and second smart hearing devices 110 and 120 according to an embodiment of the disclosure may include rechargeable lithium-ion polymer batteries and battery meters of a mobile device, which are charged through the corresponding charging modules 115 and 125.

In addition, the first and second smart hearing devices 110 and 120 according to an embodiment of the disclosure may provide sounds converted from a digital signal to an analog signal (sound energy) through the corresponding speakers 114 and 124.

For example, the first and second smart hearing devices 110 and 120 according to an embodiment of the disclosure may set the first and second control parameters corresponding to the information related to the analysis result to the voice signal and noise signal collected through the first to fourth microphones 111 to 122, and may provide a sound to the user through the speakers 114 and 124 by converting, into an analog signal, a digital signal in which the balance of at least one of the amplification value change, volume control and frequency control is adjusted.

Figure 3:
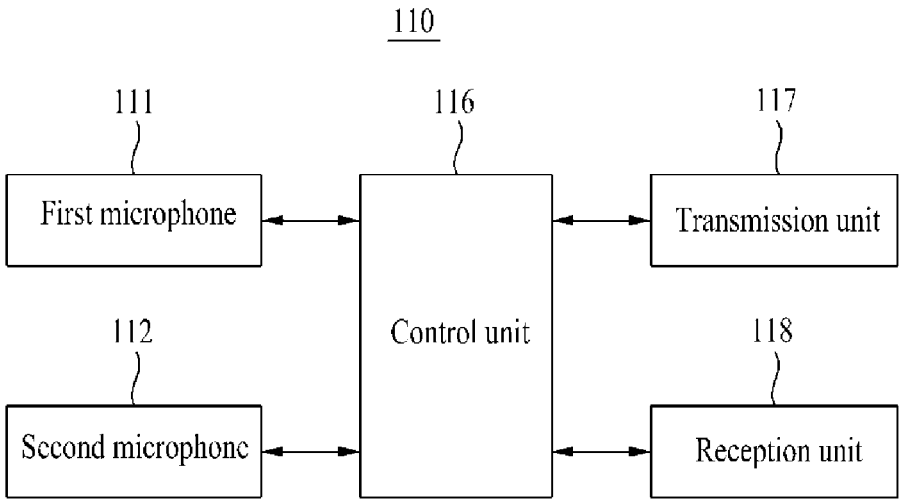
FIG. 3 is a block diagram illustrating a detailed configuration of a first smart hearing device according to an embodiment of the disclosure.
Figure 4:
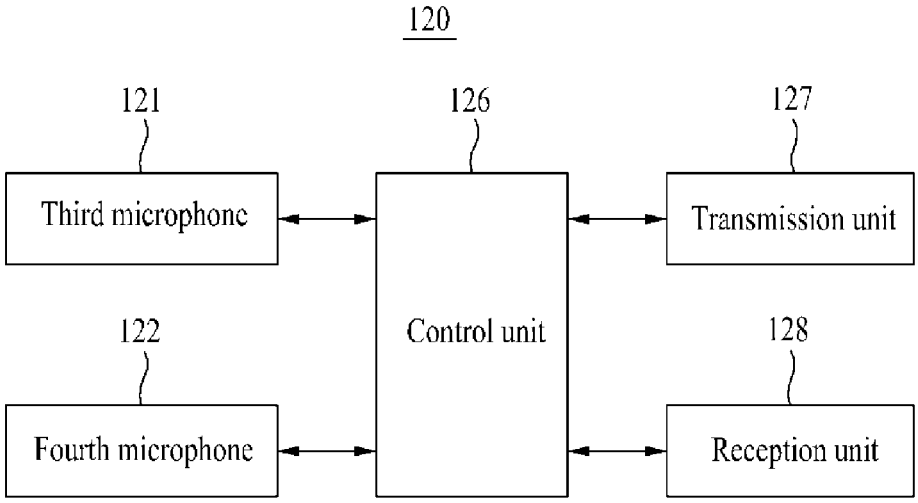
FIG. 4 is a block diagram illustrating a detailed configuration of a second smart hearing device according to an embodiment of the disclosure.

FIG. 3 is a block diagram illustrating a detailed configuration of a first smart hearing device according to an embodiment of the disclosure. FIG. 4 is a block diagram illustrating a detailed configuration of a second smart hearing device according to an embodiment of the disclosure.

Hereinafter, the first smart hearing device 110 that is worn on the left ear of a user, and the second smart hearing device 120 that is worn on the right ear of the user will be described, but the location and shape of each device are not limited thereto.

Referring to FIG. 3, a first smart hearing device according to an embodiment of the disclosure transmits a first audio signal including a voice signal and a noise signal received from first and second microphones formed on one side, and sets a first control parameter based on information about the result of analyzing the first audio signal to provide a sound of one side.

Accordingly, the first smart hearing device 110 according to an embodiment of the disclosure includes the first microphone 111, the second microphone 112, a control unit 116, a transmission unit 117, and a reception unit 118.

The first microphone 111 may receive a voice signal of a user. In addition, the second microphone 112 may receive a noise signal around the user.

In this case, the first and second microphones 111 and 112 are located at different distances based on the user mouth. For example, the first microphone 111 may be located adjacent to a user mouth to mainly receive a user voice signal, and the second microphone 112 may be located as relatively far away as possible from the user mouth compared to the first microphone 111, thereby mainly receiving an ambient noise signal.

In addition, the first and second microphones 111 and 112 are included in different positions in the first smart hearing device 110 according to an embodiment of the disclosure, but the directions in which the cavities (or holes) of the first and second microphones 111 and 112 are directed are the same for collecting uniform voice and noise signals and for removing appropriate noise accordingly. In this case, the appropriate noise may mean noise and numerical values other than the voice signal and noise signal collected at the location of a microphone.

Accordingly, the first and second microphones 111 and 112 may convert the detected voice signal and noise signal into electric signals, and provide the converted signal information to the transmission unit 117 or the control unit 116.

The transmission unit 117 may transmit the first audio signal including the voice and noise signals received from the first and second microphones 111 and 112.

For example, the transmission unit 117 may transmit the first audio signal including the voice and noise signals to the mobile device 130 possessed by a user through any short-range wireless communication module among Bluetooth, wireless fidelity (Wi-Fi), Zigbee and bluetooth low energy (BLE).

The reception unit 118 may receive result information from the mobile device 130 in response to the processing of the first audio signal by the external server 140.

For example, the reception unit 118 may receive the information related to the analysis result from the external server 140 or the mobile device 130, where the external server 140 analyzes the first audio signal through a machine learning scheme to obtain the analysis result.

In this case, the external server 140 may analyze the first audio signal including the voice and noise signals received from the mobile device 130 possessed by the user through at least one learning machine scheme of the support vector machine (SVM) and kMeans schemes. However, the machine learning scheme is not limited to the above-described SVM or kMeans scheme, and any schemes capable of machine learning using an audio signal are irrelevant.

According to an embodiment, the transmission unit 117 and the reception unit 118 of the first smart hearing device 110 according to the embodiment of the disclosure may communicate with not only a short-range wireless communication module, but also a wireless network such as a cellular telephone network, a wireless local area network (LAN), a metropolitan area network (MAN), and the like, a network such as an intranet, the Internet called World Wide Web (WWW), and the like, and other devices through wireless communication.

Such wireless communication may include Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (such as IEEE 802.11a, IEEE 802.11b, IEEE 802.11g and/or IEEE 802.11n), voice over Internet Protocol (VoIP), Wi-MAX, Long Term Evolution (LTE), Zigbee, Z-wave, Bluetooth Low Energy (BLE), Beacon, email protocols such as Internet Message Access Protocol (IMAP), Post Office Protocol (POP), and the like, instant messaging such as eXtensible Messaging and Presence Protocol (XMPP), Session Initiation Protocol for Instant Messaging and Presence Leveraging Extensions (SIMPLE), Instant Messaging and Presence Service (IMPS), Short Message Service (SMS), LoRa, and the like, or a communication protocol which has not been developed at the time when this application is filed. However, the wireless communication is not limited to the above, but a plurality of communication standards, protocols, and technologies may be used for the wireless communication.

The control unit 116 may set the first control parameter based on the result information.

In this case, the first smart hearing device 110 according to an embodiment of the disclosure may basically include left hearing data (Personal Hearing Profile) of a user who uses a hearing aid. For example, the control unit 116 may include the left hearing data of the user including volume and a frequency that the user prefers, an amplification value, volume, and a frequency range by which the user does not feel foreign. According to an embodiment, the above-described data may be stored and maintained in the mobile device 130 or the external server 140.

However, the hearing data are not limited to an item such as an amplification value, volume, a frequency, and the like, or a numerical value. For example, the hearing data may further include user preference and a numerical value for at least one piece of information among nonlinear compression information that amplifies a small sound to be large and reduces a loud sound to be small, directionality information that accurately detects the direction in which the sound is heard, feedback information that amplifies the sound received through a microphone to help to be well heard without other noise, and noise removal information that reduces noise.

The control unit 116 of the first smart hearing device 110 according to an embodiment of the disclosure may set the first control parameter of at least one among amplification value change, volume control, and frequency control corresponding to environment change and noise change, based on the left hearing data of a user and the information related to the analysis result received from at least one external terminal among the external server 140 and the mobile device 130 through the reception unit 118, thereby providing a customized hearing aid service.

In more detail, the control unit 116 may set the first control parameter to the voice and noise signals of the digital signal received from the first and second microphones 111 and 112 to adjust a balance of at least one of amplification value change, volume control and frequency control, and convert the digital signal of the adjusted signal into an analog signal to be transmitted to the user.

For example, at least one of the amplification value, volume, and frequency corresponding to the first audio signal received from the first and second microphones 111 and 112 may be out of a reference range preset or preferred by the user. This may be due to at least one of a change in environment in which the user is located, a change in the user voice, and a mechanical error. Accordingly, the control unit 116 may adjust the balance of at least one of the amplification value, volume, and frequency for the audio and noise signals based on the information related to the analysis result, and convert the digital signal corresponding to the adjusted balance into an analog signal (sound energy) to be provided to the user as sound.

That is, the first smart hearing device 110 according to an embodiment of the disclosure may transmit the first audio signal including the voice and noise signals received from the first and second microphones corresponding to the environment change of the user to the external server 140, receive the analysis result from an external device, automatically set the first control parameter for the first audio signal based on the information related to the user hearing data and analysis result, and provide the hearing aid service optimized for a changing situation without a need to separately adjust the volume or frequency by the user, thereby improving the convenience of using a hearing aid.

Referring to FIG. 4, a second smart hearing device according to an embodiment of the disclosure transmits a second audio signal including a voice signal and a noise signal received from third and fourth microphones formed on an opposite side, and sets a second control parameter based on information about the result of analyzing the second audio signal to provide a sound of an opposite side.

Accordingly, the second smart hearing device 120 according to an embodiment of the disclosure includes the third microphone 121, the fourth microphone 122, a control unit 126, a transmission unit 127, and a reception unit 128.

The third microphone 121 may receive a voice signal of a user. In addition, the fourth microphone 122 may receive a noise signal around the user.

In this case, the third and fourth microphones 121 and 122 are located at different distances based on the user mouth. For example, the third microphone 121 may be located adjacent to a user mouth to mainly receive a user voice signal, and the fourth microphone 122 may be located as relatively far away as possible from the user mouth compared to the third microphone 121, thereby mainly receiving an ambient noise signal.

In addition, the third and fourth microphones 121 and 122 are included in different positions in the second smart hearing device 120 according to an embodiment of the disclosure, but the directions in which the cavities (or holes) of the third and fourth microphones 121 and 122 are directed are the same for collecting uniform voice and noise signals and for removing appropriate noise accordingly. In this case, the appropriate noise may mean noise and numerical values other than the voice signal and noise signal collected at the location of a microphone.

Accordingly, the third and fourth microphones 121 and 122 may convert the detected voice signal and noise signal into electric signals, and provide the converted signal information to the transmission unit 127 or the control unit 126.

The transmission unit 127 may transmit the second audio signal including the voice and noise signals received from the third and fourth microphones 121 and 122.

For example, the transmission unit 127 may transmit the second audio signal including the voice and noise signals to the mobile device 130 possessed by a user through any short-range wireless communication module among Bluetooth, wireless fidelity (Wi-Fi), Zigbee and bluetooth low energy (BLE).

The reception unit 128 may receive result information from the mobile device 130 in response to the processing of the first audio signal by the external server 140.

For example, the reception unit 128 may receive the information related to the analysis result from the external server 140 or the mobile device 130, where the external server 140 analyzes the second audio signal through a machine learning scheme to obtain the analysis result.

In this case, the external server 140 may analyze the first audio signal including the voice and noise signals received from the mobile device 130 possessed by the user through at least one learning machine scheme of the support vector machine (SVM) and kMeans schemes. However, the machine learning scheme is not limited to the above-described SVM or kMeans scheme, and any schemes capable of machine learning using an audio signal are irrelevant.

According to an embodiment, the transmission unit 127 and the reception unit 128 of the second smart hearing device 120 according to the embodiment of the disclosure may communicate with not only a short-range wireless communication module, but also a wireless network such as a cellular telephone network, a wireless local area network (LAN), a metropolitan area network (MAN), and the like, a network such as an intranet, the Internet called World Wide Web (WWW), and the like, and other devices through wireless communication.

Such wireless communication may include Global System for Mobile Communications (GSM), Enhanced Data GSM Environment (EDGE), wideband code division multiple access (W-CDMA), code division multiple access (CDMA), time division multiple access (TDMA), Bluetooth, Wireless Fidelity (Wi-Fi) (such as IEEE 802.11a, IEEE 802.11b, IEEE 802.11g and/or IEEE 802.11n), voice over Internet Protocol (VoIP), Wi-MAX, Long Term Evolution (LTE), Zigbee, Z-wave, Bluetooth Low Energy (BLE), Beacon, email protocols such as Internet Message Access Protocol (IMAP), Post Office Protocol (POP), and the like, instant messaging such as eXtensible Messaging and Presence Protocol (XMPP), Session Initiation Protocol for Instant Messaging and Presence Leveraging Extensions (SIMPLE), Instant Messaging and Presence Service (IMPS), Short Message Service (SMS), LoRa, and the like, or a communication protocol which has not been developed at the time when this application is filed. However, the wireless communication is not limited to the above, but a plurality of communication standards, protocols, and technologies may be used for the wireless communication.

The control unit 126 may set the second control parameter based on the result information.

In this case, the second smart hearing device 120 according to an embodiment of the disclosure may basically include right hearing data (Personal Hearing Profile) of a user who uses a hearing aid. For example, the control unit 126 may include the right hearing data of the user including volume and a frequency that the user prefers, an amplification value, volume, and a frequency range by which the user does not feel foreign. According to an embodiment, the above-described data may be stored and maintained in the mobile device 130 or the external server 140.

However, the hearing data are not limited to an item such as an amplification value, volume, a frequency, and the like, or a numerical value. For example, the hearing data may further include user preference and a numerical value for at least one piece of information among nonlinear compression information that amplifies a small sound to be large and reduces a loud sound to be small, directionality information that accurately detects the direction in which the sound is heard, feedback information that amplifies the sound received through a microphone to help to be well heard without other noise, and noise removal information that reduces noise.

The control unit 126 of the second smart hearing device 120 according to an embodiment of the disclosure may set the second control parameter of at least one among amplification value change, volume control, and frequency control corresponding to environment change and noise change, based on the right hearing data of a user and the information related to the analysis result received from at least one external terminal among the external server 140 and the mobile device 130 through the reception unit 128, thereby providing a customized hearing aid service.

In more detail, the control unit 126 may set the second control parameter to the voice and noise signals of the digital signal received from the third and fourth microphones 121 and 122 to adjust a balance of at least one of amplification value change, volume control and frequency control, and convert the digital signal of the adjusted signal into an analog signal to be transmitted to the user.

For example, at least one of the amplification value, volume, and frequency corresponding to the first audio signal received from the third and fourth microphones 121 and 122 may be out of a reference range preset or preferred by the user. This may be due to at least one of a change in environment in which the user is located, a change in the user voice, and a mechanical error. Accordingly, the control unit 126 may adjust the balance of at least one of the amplification value, volume, and frequency for the audio and noise signals based on the information related to the analysis result, and convert the digital signal corresponding to the adjusted balance into an analog signal (sound energy) to be provided to the user as sound.

That is, the second smart hearing device 120 according to an embodiment of the disclosure may transmit the first audio signal including the voice and noise signals received from the first and second microphones corresponding to the environment change of the user to the external server 140, receive the analysis result from an external device, automatically set the second control parameter for the second audio signal based on the information related to the user hearing data and analysis result, and provide the hearing aid service optimized for a changing situation without a need to separately adjust the volume or frequency by the user, thereby improving the convenience of using a hearing aid.

Figure 5:
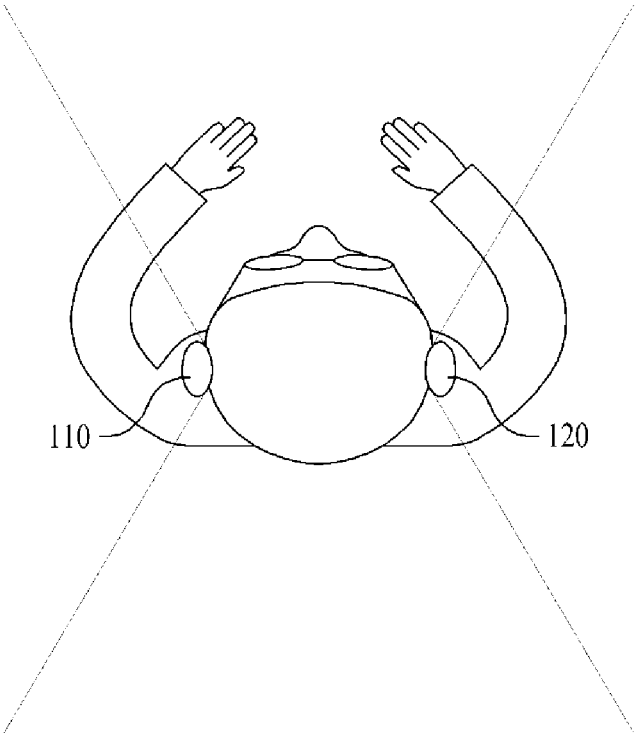
FIGS. 5, 6A and 6B illustrate examples of application of a smart hearing device according to an embodiment of the disclosure.
Figure 6A:
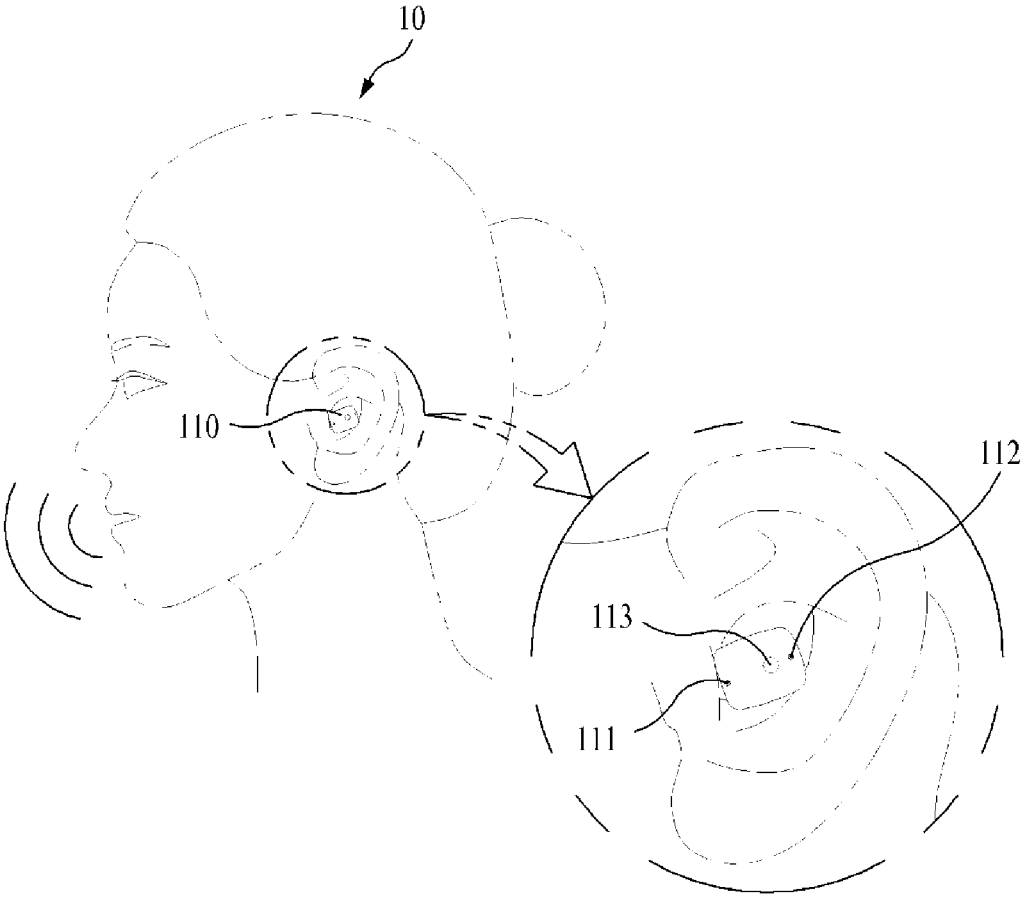
Figure 6B:
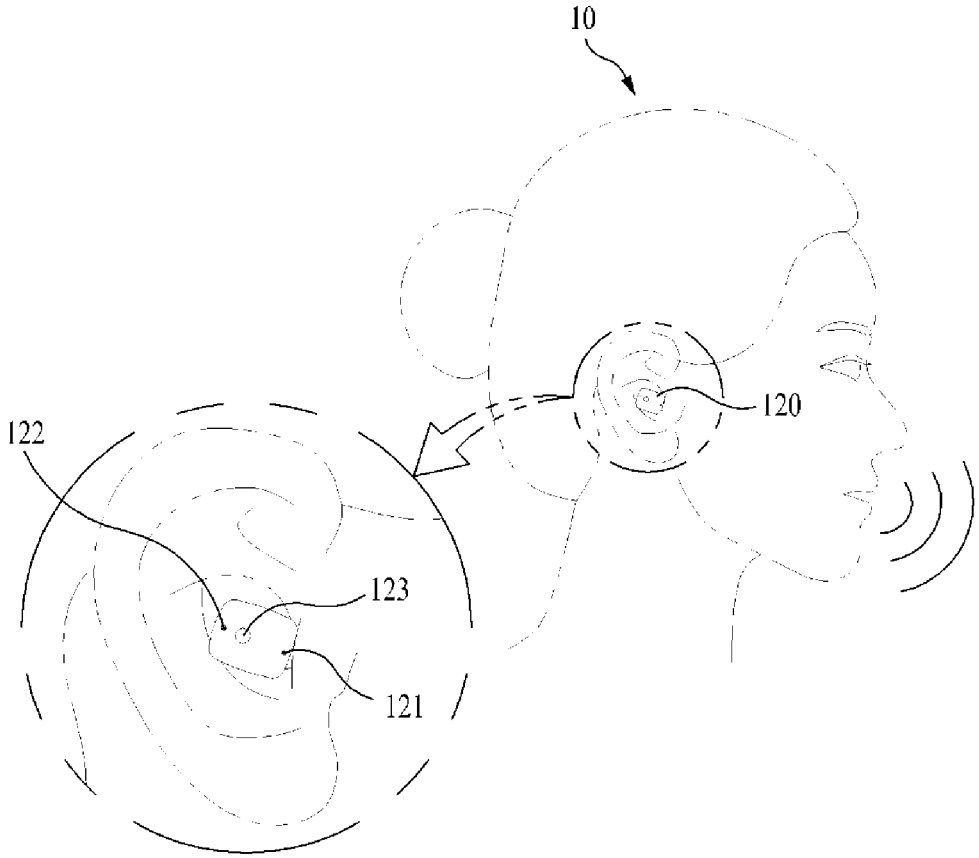

FIGS. 5, 6A and 6B illustrate examples of application of a smart hearing device according to an embodiment of the disclosure.

In more detail, FIG. 5 is a diagram illustrating an example of a user wearing a smart hearing device according to an embodiment of the disclosure as viewed from the top. FIG. 6A is a diagram illustrating an example of a user wearing a first smart hearing device according to an embodiment of the disclosure as viewed from the left. FIG. 6B is a diagram illustrating an example of a user wearing a second smart hearing device according to an embodiment of the disclosure as viewed from the right.

Referring to FIG. 5, a user 10 wears the first smart hearing device 110 on the left ear and the second smart hearing device 120 on the right ear. The user 10 may wear both the first and second smart hearing devices 110 and 120, so that the user 10 may recognize the environment change and noise change according to the sound directionality of the left and right sides more three-dimensionally, thereby receiving a customized hearing aid service.

Referring to FIG. 6A, the first smart hearing device 110 according to an embodiment of the disclosure may be mounted on the left ear of the user 10, and the first and second microphones 111 and 112 may be located at different distances from the user mouth.

For example, the first microphone 111 is located closer to the user mouth than the second microphone 112, and may mainly receive a user voice signal. To the contrary, the second microphone 112 may be located as relatively far away as possible from the user mouth compared to the first microphone 111, thereby mainly receiving an ambient noise signal corresponding to the location of the user.

In this case, as shown in FIG. 6A, it may be identified that the first and second microphones 111 and 112 are located near or far away from the user mouth based on the on/off switch 113.

In addition, the first and second microphones 111 and 112 are included in different locations in the first smart hearing device 110 according to an embodiment of the disclosure, but the directions in which the cavities (or holes) of the first and second microphones 111 and 112 are directed are the same for collecting uniform voice and noise signals and for removing appropriate noise accordingly.

Referring to FIG. 6B, the second smart hearing device 120 according to an embodiment of the disclosure may be mounted on the right ear of the user 10, and the third and fourth microphones 121 and 122 may be located at different distances from the user mouth.

For example, the third microphone 121 may be located closer to the user mouth than the fourth microphone 122, and may mainly receive a user voice signal. To the contrary, the fourth microphone 122 may be located as relatively far away as possible from the user mouth compared to the third microphone 121, thereby mainly receiving an ambient noise signal corresponding to the location of the user.

In this case, as shown in FIG. 6B, it may be identified that the third and fourth microphones 121 and 122 are located near or far away from the user mouth based on the on/off switch 113.

In addition, the third and fourth microphones 121 and 122 are included in different locations in the second smart hearing device 120 according to an embodiment of the disclosure, but the directions in which the cavities (or holes) of the third and fourth microphones 121 and 122 are directed are the same for collecting uniform voice and noise signals and for removing appropriate noise accordingly.

Figure 7:
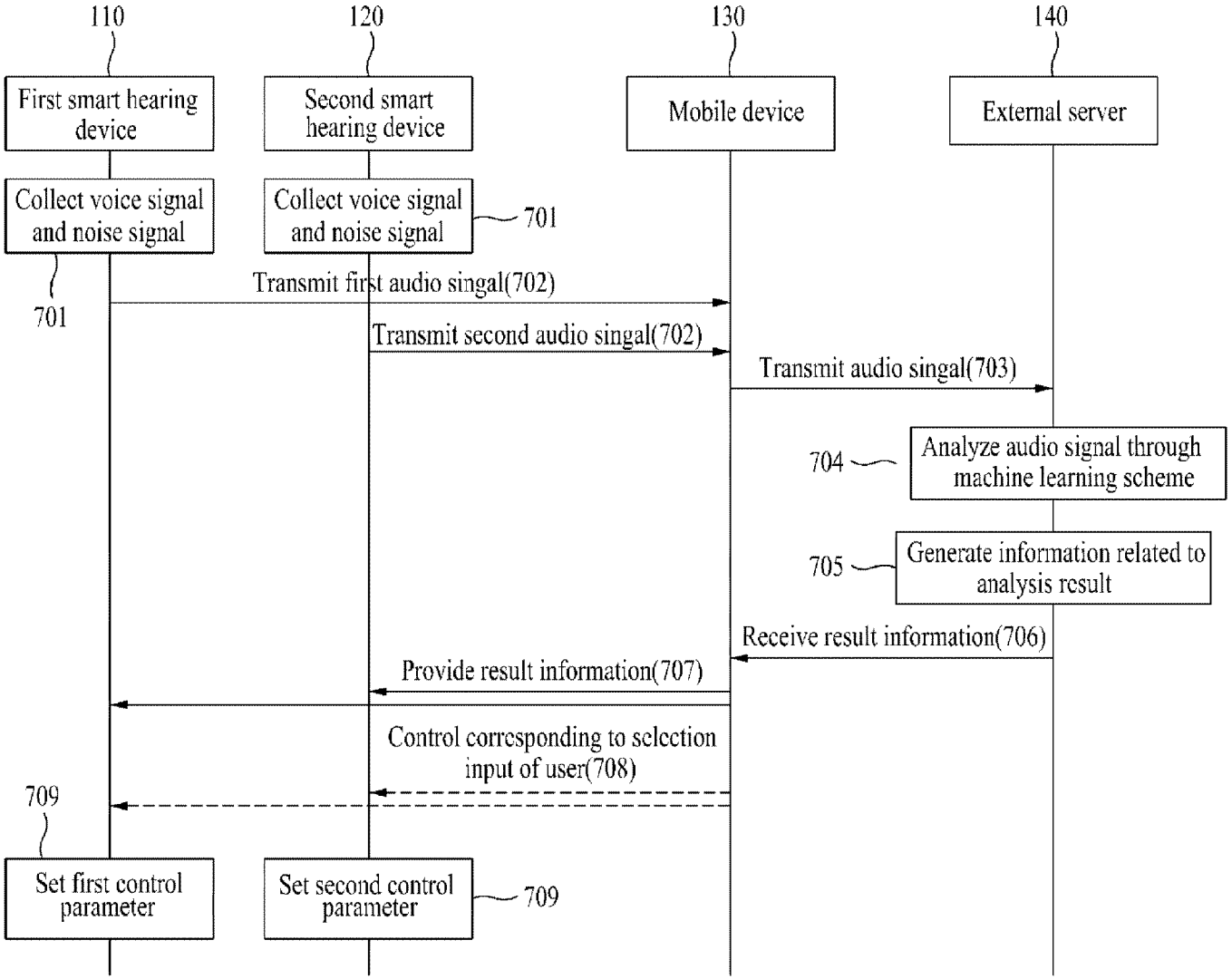
FIG. 7 is a flowchart illustrating an operation process between the first and second smart hearing devices, the mobile device, and the external server according to an embodiment of the disclosure.

FIG. 7 is a flowchart illustrating an operation process between the first and second smart hearing devices, the mobile device, and the external server according to an embodiment of the disclosure.

Referring to FIG. 7, in operation 701, the first and second smart hearing devices 110 and 120 may be mounted on the left and right ears of the user to collect the voice signal of the user and the ambient noise signal, respectively.

In operations 702 and 703, the mobile device 130 receives the first and second audio signals including the voice signal and noise signal from the first smart hearing device 110 formed on the left and the second smart hearing device 120 formed on the right, and transmits the first and second audio signals to the external server 140.

In this case, the first and second smart hearing devices 110 and 120 may transmit the first and second audio signals to the mobile device 130 through Bluetooth communication, respectively. The mobile device 130 may transmit the first and second audio signals to the external server 140 through wireless data communication of Ethernet/3G, 4G, or 5G.

Thereafter, in operations 704 and 705, the external server 140 may analyze the first and second audio signals received from the mobile device 130 by using at least one machine learning scheme of support vector machine (SVM) and kMeans schemes to generate information related to the analysis result.

For example, the external server 140 may analyze the first and second audio signals through the machine learning scheme to detect changes in the environment such as the use environment and the work environment according to the user location, and may detect a change in a numerical value of at least one of an amplification value, volume, and a frequency corresponding to the environment change. Accordingly, the external server 140 may obtain at least one item of the amplification value, volume, and frequency that are out of an appropriate range corresponding to the user hearing data, and a numerical value, and may generate the analysis result including information about the obtained item and numerical value and information about the numerical value change for entry into an appropriate range.

According to an embodiment, operations 704 and 705 performed by the external server 140 may be performed by the mobile device 130. The mobile device 130 may analyze the first and second audio signals by using at least one machine learning scheme of the support vector machine (SVM) and kMeans schemes to generate information related to the analysis result.

In operation 706, the mobile device 130 receives result information on the sound directionality analyzed by the machine learning scheme from the external server 140.

Then, in operation 707, the mobile device 130 provides the result information to the first and second smart hearing devices 110 and 120.

As an example, when there is no user's selection input in operation 706, in operation 707, the mobile device 130 may store the information related to the analysis result received from the external server 140, or transmit the information to the first and second smart hearing devices 110 and 120. As another embodiment, the mobile device 130 may provide the information related to the received analysis result through the display in operation 706, and may control the first and second smart hearing devices 110 and 120 corresponding to the user's selection input in operation 708.

Accordingly, in operation 709, each of the first and second smart hearing devices 110 and 120 sets the first and second control parameters based on the result information received from the mobile device 130 to provide the sounds of the left and right to the user.

For example, the first and second smart hearing devices 110 and 120 may set the first and second control parameters to the first and second audio signals received from microphones based on the information related to the received analysis result to adjust the balance of at least one of the amplification value change, volume control and frequency control, and may convert the digital signal of the adjusted signal into an analog signal to provide the customized hearing aid service to the user. Accordingly, the user may recognize the environment change, noise change and voice change more three-dimensionally due to the sound of the left output through the first smart hearing device 110 and the sound of the right output through the second smart hearing device 120.

The foregoing devices may be realized by hardware elements, software elements and/or combinations thereof. For example, the devices and components illustrated in the exemplary embodiments of the disclosure may be implemented in one or more general-use computers or special-purpose computers, such as a processor, a controller, an arithmetic logic unit (ALU), a digital signal processor, a microcomputer, a field programmable array (FPA), a programmable logic unit (PLU), a microprocessor or any device which may execute instructions and respond. A processing unit may execute an operating system (OS) or one or software applications running on the OS. Further, the processing unit may access, store, manipulate, process and generate data in response to execution of software. It will be understood by those skilled in the art that although a single processing unit may be illustrated for convenience of understanding, the processing unit may include a plurality of processing elements and/or a plurality of types of processing elements. For example, the processing unit may include a plurality of processors or one processor and one controller. Also, the processing unit may have a different processing configuration, such as a parallel processor.

Software may include computer programs, codes, instructions or one or more combinations thereof and may configure a processing unit to operate in a desired manner or may independently or collectively control the processing unit. Software and/or data may be permanently or temporarily embodied in any type of machine, components, physical equipment, virtual equipment, computer storage media or units or transmitted signal waves so as to be interpreted by the processing unit or to provide instructions or data to the processing unit. Software may be dispersed throughout computer systems connected via networks and may be stored or executed in a dispersion manner. Software and data may be recorded in one or more computer-readable storage media.

The methods according to the above-described exemplary embodiments of the disclosure may be implemented with program instructions which may be executed through various computer means and may be recorded in computer-readable media. The media may also include, alone or in combination with the program instructions, data files, data structures, and the like. The program instructions recorded in the media may be designed and configured specially for the exemplary embodiments of the disclosure or be known and available to those skilled in computer software. Computer-readable media include magnetic media such as hard disks, floppy disks, and magnetic tape; optical media such as compact disc-read only memory (CD-ROM) disks and digital versatile discs (DVDs); magneto-optical media such as floptical disks; and hardware devices that are specially configured to store and perform program instructions, such as read-only memory (ROM), random access memory (RAM), flash memory, and the like. Program instructions include both machine codes, such as produced by a compiler, and higher level codes that may be executed by the computer using an interpreter. The described hardware devices may be configured to act as one or more software modules to perform the operations of the above-described exemplary embodiments of the disclosure, or vice versa.

While a few exemplary embodiments have been shown and described with reference to the accompanying drawings, it will be apparent to those skilled in the art that various modifications and variations can be made from the foregoing descriptions. For example, adequate effects may be achieved even if the foregoing processes and methods are carried out in different order than described above, and/or the aforementioned elements, such as systems, structures, devices, or circuits, are combined or coupled in different forms and modes than as described above or be substituted or switched with other components or equivalents.

Thus, it is intended that the disclosure covers other realizations and other embodiments of this disclosure provided they come within the scope of the appended claims and their equivalents.

The invention claimed is:

1. An adaptive solid hearing system comprising:

a first smart hearing device configured to transmit a first audio signal including a voice signal and a noise signal received from a first microphone and a second microphone formed on one side, and set a first control parameter based on information about a result of analyzing the first audio signal to provide a sound of the one side;

a second smart hearing device configured to transmit a second audio signal including a voice signal and a noise signal received from a third microphone and a fourth microphone formed on an opposite side, and set a second control parameter information about a result of analyzing the second audio signal to a sound of the opposite side;

a mobile device configured to transmit the first audio signal and the second audio signal to an outside, and control the first smart hearing device and the second smart hearing device; and an external server configured to transmit result information about sound directionality analyzed by applying a machine learning scheme to the first audio signal and the second audio signal, wherein the first smart hearing device and the second smart hearing device include the first microphone and the third microphone positioned near a mouth of a user, and the second microphone and the fourth microphone positioned at a spaced distance from the mouth of the user, respectively, wherein the first microphone and the third microphone are configured to collect a voice signal of the user at the one side and the opposite side, and the second microphone and the fourth microphone are configured to collect a noise signal of the one side and a noise signal of the opposite side, wherein the first microphone and the third microphone are paired with each other, and the second microphone and the fourth microphone are paired with each other, and wherein one microphone paired with another microphone is automatically set according to a setting applied to the another microphone.

2. An adaptive solid hearing system comprising:

a first smart hearing device configured to transmit a first audio signal including a voice signal and a noise signal received from a first microphone and a second microphone formed on one side, and set a first control parameter based on information about a result of analyzing the first audio signal to provide a sound of the one side;

a second smart hearing device configured to transmit a second audio signal including a voice signal and a noise signal received from a third microphone and a fourth microphone formed on an opposite side, and set a second control parameter information about a result of analyzing the second audio signal to a sound of the opposite side;

a mobile device configured to transmit the first audio signal and the second audio signal to an outside, and control the first smart hearing device and the second smart hearing device; and an external server configured to transmit result information about sound directionality analyzed by applying a machine learning scheme to the first audio signal and the second audio signal, wherein the first smart hearing device is configured to set the first control parameter of at least one among an amplification value change, a volume control and a frequency control according to an environment change, based on hearing data of a user and the result information received from the mobile device, and provide the sound of the one side which is user-customized;

wherein the second smart hearing device is configured to set the second control parameter of at least one among an amplification value change, a volume control, and a frequency control according to the environment change, based on hearing data of the user and the result information received from the mobile device, and provide the sound of the opposite side which is user-customized, wherein the first smart hearing device is configured to set the first control parameter to the voice signal and the noise signal of a digital signal received from the first microphone and the second microphone to adjust a balance of at least one of the amplification value change, the volume control and the frequency control, and convert a digital signal for the adjusted signal into an analog signal to provide the user with the sound of the one side, and wherein the second smart hearing device is configured to set the second control parameter to the voice signal and the noise signal of a digital signal received from the third microphone and the fourth microphone to adjust a balance of at least one of the amplification value change, the volume control and the frequency control, and convert a digital signal for the adjusted signal into an analog signal to provide the user with the sound of the opposite side.

3. The adaptive solid hearing system of claim 2, wherein each of the first smart hearing device and the second smart hearing device is configured to provide the sound of the one side and the sound of the opposite side user-customized to the user to enable the user to recognize an environment change and a noise change corresponding to sound directionality of left and right sides in three dimensions.

4. An adaptive solid hearing system comprising:

a first smart hearing device configured to transmit a first audio signal including a voice signal and a noise signal received from a first microphone and a second microphone formed on one side, and set a first control parameter based on information about a result of analyzing the first audio signal to provide a sound of the one side;

a second smart hearing device configured to transmit a second audio signal including a voice signal and a noise signal received from a third microphone and a fourth microphone formed on an opposite side, and set a second control parameter information about a result of analyzing the second audio signal to a sound of the opposite side;

a mobile device configured to transmit the first audio signal and the second audio signal to an outside, and control the first smart hearing device and the second smart hearing device; and an external server configured to transmit result information about sound directionality analyzed by applying a machine learning scheme to the first audio signal and the second audio signal, wherein each of the first smart hearing device and the second smart hearing device is configured to set the first control parameter and the second control parameter having different parameter values based on left hearing data and right hearing data of a user.

5. The adaptive solid hearing system of claim 4, wherein the mobile device is configured to transmit the first audio signal and the second audio signal received from the first smart hearing device and the second smart hearing device through a short-range wireless communication module to the external server, and transmit the result information received from the external server to the first smart hearing device and the second smart hearing device.

6. The adaptive solid hearing system of claim 5, wherein the mobile device is configured to control one or more of power on/off, signal collection, and parameter setting of each of the first smart hearing device and the second smart hearing device corresponding to a selection input of a user.

7. The adaptive solid hearing system of claim 4, wherein the external server is configured to analyze the first audio signal and the second audio signal through a machine learning technique of one of support vector machine (SVM) and kMeans schemes to generate the result information about sound directionality corresponding to environment change or ambient noise.

8. The adaptive solid hearing system of claim 4, wherein the first smart hearing device includes:

the first microphone configured to receive a voice signal of a user;

the second microphone configured to receive a noise signal around the user;

a transmission unit configured to transmit the first audio signal including the voice signal and the noise signal received from the first microphone and the second microphone;

a reception unit configured to receive the result information from the mobile device in response to processing of the first audio signal by the external server; and a control unit configured to set the first control parameter based on the result information.

9. The adaptive solid hearing system of claim 4, wherein the second smart hearing device includes:

the third microphone configured to receive a voice signal of a user;

the fourth microphone configured to receive a noise signal around the user;

a transmission unit configured to transmit the second audio signal including the voice signal and the noise signal received from the third microphone and the fourth microphone;

a reception unit configured to receive the result information from the mobile device in response to processing of the second audio signal by the external server; and a control unit configured to set the second control parameter based on the result information.

* * * * *